United States Patent [19]

Oldfather

[11] Patent Number: 4,844,331

[45] Date of Patent: Jul. 4, 1989

[54] SELF-LOCKING CORNER STRUCTURE

[75] Inventor: Nevin L. Oldfather, Columbus, Ohio

[73] Assignee: Boise Cascade Corporation, Boise, Id.

[21] Appl. No.: 211,753

[22] Filed: Jun. 24, 1988

[51] Int. Cl.[4] ..... B65D 5/22

[52] U.S. Cl. ..... 229/178; 229/190

[58] Field of Search ..... 229/190, 192, 195, 198, 229/49, 6 R, 16 R, 164, 178

[56] References Cited

U.S. PATENT DOCUMENTS

| | | | |
|---|---|---|---|
| 3,335,935 | 8/1967 | McCallum | 229/190 |
| 3,616,989 | 11/1971 | Martinek et al. | 229/190 |
| 4,128,167 | 12/1978 | Hogshead, III | 229/178 |
| 4,133,430 | 1/1979 | Cravens | 229/178 |
| 4,305,543 | 12/1981 | Lai | 229/192 |

FOREIGN PATENT DOCUMENTS

| | | | |
|---|---|---|---|
| 2321431 | 3/1977 | France | 229/190 |
| 2547795 | 12/1984 | France | 229/178 |
| 408764 | 6/1966 | Switzerland | 229/190 |
| 1181009 | 2/1970 | United Kingdom | 229/190 |

OTHER PUBLICATIONS

Drawings I and II submitted by applicant as prior art on 12-19-88.

*Primary Examiner*—Gary Elkins

*Attorney, Agent, or Firm*—Rogers, Howell & Haferkamp

[57] ABSTRACT

A self-locking corner structure for trays, cartons, lids, or the like has a generally plainer main panel and first and second side panels foldable along fold lines relative to the main panel to positions normal to each other and to the main panel to form a corner structure. One of the side panels has a flap portion at one end thereof foldable along a fold line to a position parallel and with one of its side surfaces adjacent to the other side panel, the flap portion having a sloping edge. The other of the side panels has a tab portion foldable along a sloping fold line generally parallel and adjacent to said sloping edge with the side panels positioned normal to the main panel and normal to each other and with the flap folded to a position parallel to the other side panel. The tab portion is foldable along the sloping fold line over the sloping edge, and downwardly adjacent the other side surface of the flap, and is held in said folded position to lock the side panels in position normal to each other and the main panel.

13 Claims, 1 Drawing Sheet

SELF-LOCKING CORNER STRUCTURE

BACKGROUND AND SUMMARY OF THE INVENTION

This invention generally relates to a corner structure for trays, cartons, lids, and the like, and more particularly to a corner structure of the self-locking type.

Self-locking corner structures and other self-locking structures for use in cartons and the like are generally known. Examples are shown in U.S. Pat. Nos. 1,838,154; 2,307,720; 2,488,705; 3,902,653; 4,313,555; and 4,469,273. While these structures may be useful for their intended purposes, the self-locking corner structure of the present invention is believed to provide improved strength and ease of assembly resulting in a very secure structure without the use of additional materials or extra fasteners. Generally, this is accomplished in accordance with the present invention by the use of a fold over locking tab associated with one of the adjacent side panels which folds over a sloping edge of a flap associated with another adjacent side panel to lock the side panels in positions normal to each other and to the main panel. The entire structure is formed from a die-cut blank with means defining the various fold lines for the side panels, flap and tab.

DETAILED DESCRIPTION OF A PREFERRED EMBODIMENT

Figure 1:
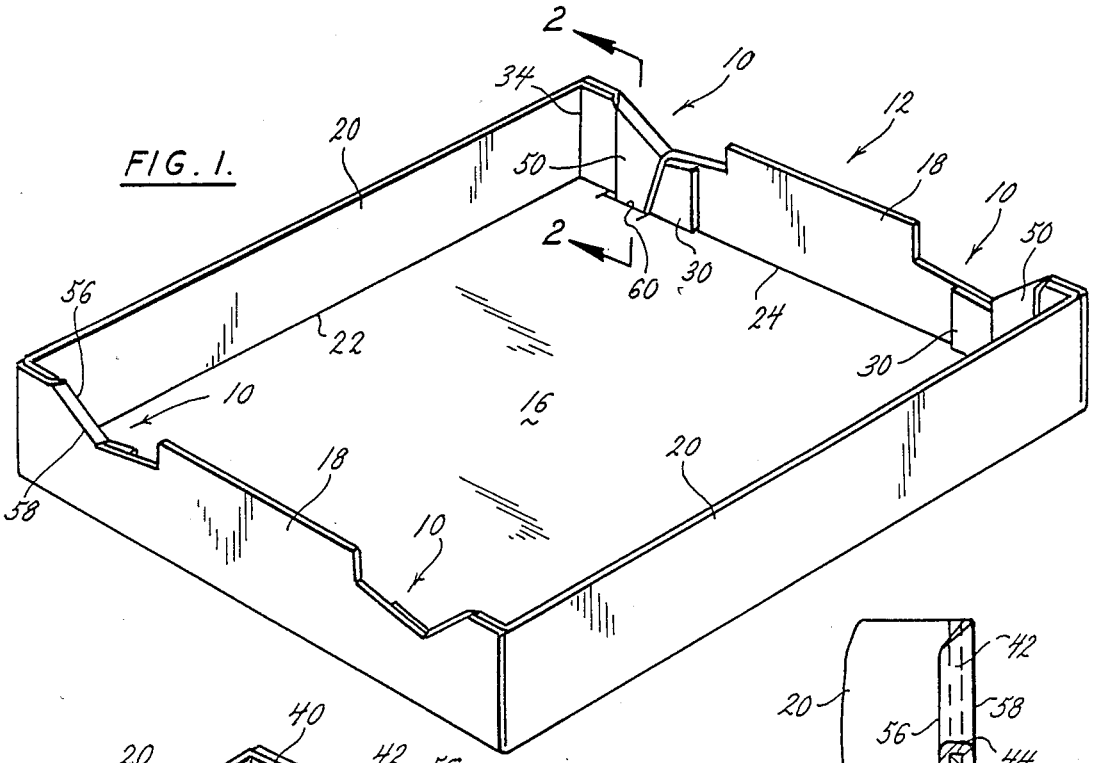
FIG. 1 is a perspective view of a tray, lid, box, or the like having self-locking corner structures of the present invention.

With reference to the drawing there is shown a self-locking corner structure 10 of the present invention for use in forming a tray, lid, carton, or the like 12. It will be noted that the tray 12 actually includes four such assemblies 10.

Figure 3:
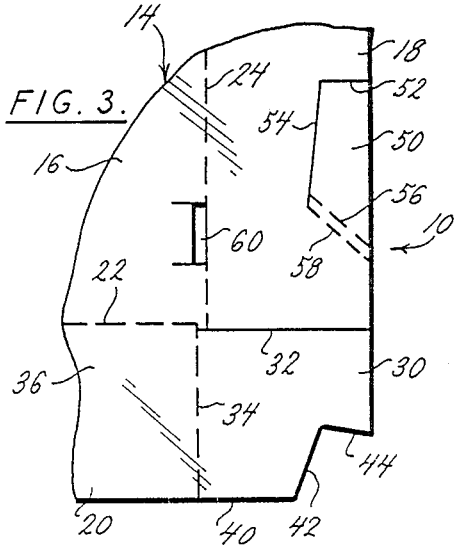
FIG. 3 is a plan view of a corner of a die-cut blank showing a corner structure of the present invention.

The entire structure is formed from a die-cut blank 14, a corner of which is shown in FIG. 3. The tray includes a main panel 16, first side panels 18, and second side panels 20. The side panels are foldable along fold lines 22 and 24 to positions normal to the main panel 16 and such that the side panels 18 are normal to the side panels 20 to form the corners of the tray.

The corner assemblies 10 are identical. Each is formed from a flap portion 30 at an end of a side panel 18. The flap portion 30 is formed by a slit 32 in the die blank which is parallel to the fold line 22 for the side panel 20, and by a fold line 34 which is parallel to the fold line 24 for the side panel 18. Hence, the flap portion 30 is foldable along the fold line 34, which is vertical relative to the main panel 16 with the side panel 20 normal to the main panel. The flap portion 30 is foldable to a position normal to a main portion 36 of the side panel 20.

The top edge of the flap portion 30, when viewed in its folded configuration as in FIGS. 1, 2, 4 and 5, has a generally horizontal edge portion 40 extending from the fold line, followed by a downwardly sloping edge portion 42, followed by an upwardly sloping edge portion 44. The downwardly sloping edge portion 42 is at about 45° relative to the plainer surface of the main panel 16. The amount of upward slope of the edge portion 44 is not particularly critical, except that some upward slope is desirable as it provides a more secure locking structure by preventing the flap portion from pulling away from the locking tab as will be described.

Figure 2:
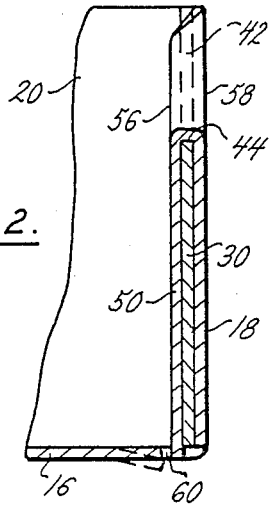
FIG. 2 is a view in section taken generally along the line 2—2 of FIG. 1.
Figure 5:
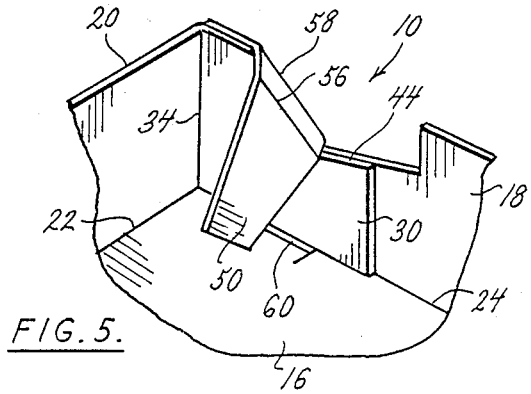

The corner assembly further includes a locking tab portion 50 formed near an end and adjacent the top edge of each side panel 18. The tab 50 is formed in the die-cut blank 14 by slits 52 and 54 and closely spaced parallel fold lines 56 and 58. The fold lines 56 and 58 are parallel and adjacent to the sloping edge portion 42 of the flap with the flap and side panels in the assembled position as shown in FIGS. 1, 2, and 5. Also, the slit 54 is parallel and adjacent to the edge 44 of the flap so that the tab will clear the edge 44 when folded over the flap as will be described. The length of the tab 50 is such that it will fold over the sloping edge 42 of the flap and extend downwardly along one side surface of the flap to slightly below the flap. A slot 60 is cut into the main panel near the corner adjacent an edge of the main panel and directly below the sloping edge 42 to receive the end of the tab 50.

Figure 4:
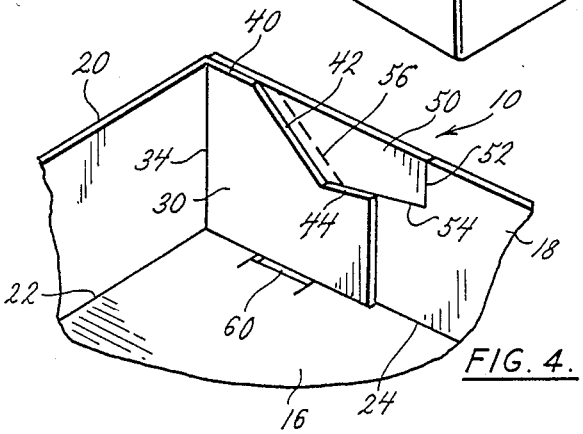
FIG. 4 is a view showing a corner structure of the present invention at a partial stage of assembly from the blank of FIG. 3; and, FIG. 5 is a view similar to FIG. 4 and showing the corner structure at a further stage of assembly.

To assemble the tray and each of its corner structures the side panels 20 are folded upwardly along the fold lines 22 to positions normal to the main panel 16. Next the flaps 30 are folded along the fold lines 34 to positions normal to the main portions 36 of the side panels 20 and also normal to the main panel. Next the panels 18 are folded along the fold lines 24 to positions normal to the main panel such that the ends of the side panels 18 lie adjacent the outside surfaces of the flaps 30 as shown in FIG. 4. The tabs 50 are then folded along the fold lines 56 and 58 over the sloping edges 42 of the flaps (FIG. 5) and downwardly to lie next to the inner side surfaces of the flaps 30, and the bottom ends of the tabs are inserted into the slots 60 to lock the tabs in place as shown in FIGS. 1 and 2.

When assembled each corner structure is firmly secured with the flap locked in position between the side panel 18 and tab 50 so that adjacent side panels 18 and 20 are locked in positions normal to the main panel and normal to each other.

The entire assembly may be made of corrugated box board or other suitable material and the various fold lines may be made by creasing, scoring, slotting, or the like.

I claim:

1. A self-locking corner structure for trays, cartons, lids, and the like, comprising:

(a) a generally planar main panel, (b) first and second side panels foldable along fold lines relative to the main panel to positions normal to each other and to the main panel to form a corner structure, (c) one of said side panels having a flap portion at one end thereof foldable along a fold line to a position parallel and with one of its side surfaces adjacent to the other side panel, said flap portion having a sloping edge, (d) the other of said side panels having a tab portion foldable along a fold line generally parallel to said sloping edge with the side panels positioned normal to said main panel and normal to each other and with the flap folded to a position parallel to said other side panel, said tab portion being formed from the material of said other side panel;

(e) said tab portion being foldable along said sloping fold line, over said sloping edge, and downwardly adjacent the other side surface of the flap thereby leaving a void in said other side panel previously occupied by said tab, and (f) means for holding said tab in said folded over position to lock said side panels in position normal to each other and said main panel.

2. The structure of claim 1 wherein said means for holding further comprises a slot into which the end of said tab extends in locking engagement.

3. The structure of claim 2 wherein said slot is near an edge of the main panel directly below said sloping edge of said flap with said flap folded to a position parallel to said other side panel.

4. The structure of claim 1 wherein said entire structure is formed from a die-cut blank with means defining said fold lines.

5. The structure of claim 1 wherein said sloping edge slopes downwardly at about 45° with respect to the planar surface of said main panel.

6. The structure of claim 1 wherein said flap has a second sloping edge that extends from the other sloping edge away from the corner and that slopes upwardly with respect to the planar surface of said main panel.

7. A tray or the like comprising a generally planar main panel and side panels foldable along fold lines relative to the main panel to positions normal to each other and to the main panel, the tray formed from a die-cut blank having means defining the fold lines and having corner structures, each such corner structure further comprising:

(a) the generally planar main panel, (b) adjacent side panels, (c) one of the adjacent side panels having a flap portion at one end thereof foldable along a fold line to a position parallel and with one of its side surfaces adjacent to the other side panel, said flap portion having a sloping edge, (d) the other of said adjacent side panels having a tab portion foldable along a fold line generally parallel to said sloping edge with the side panels positioned normal to the main panel and normal to each other and with the flap folded to a position parallel to said other side panel, said tab portion being formed from the material of said other side panel, (e) said tab portion being foldable along said sloping fold line, over said sloping edge, and downwardly adjacent the other side surface of the flap thereby leaving a void in said other side panel previously occupied by said tab, and (f) means for holding said tab in said folded over position to lock said adjacent side panels in position normal to each other and said main panel.

8. The tray of claim 7 wherein said side panels are all the same height except for the locations of the voids left by the tab portions.

9. The tray of claim 7 wherein each tab portion is formed with the length of the tab portion extending generally along the length of the panel in which it is formed.

10. The tray of claim 7 wherein said means for holding further comprise slots into which the ends of said tabs extend in locking engagement.

11. The tray of claim 10 wherein said slots are near edges of the main panel directly below the sloping edges of the flaps with the flaps folded to positions parallel to said other side panels.

12. The tray of claim 7 wherein each flap has a second sloping edge that extends from the other sloping edge away from the corner and that slops upwardly with respect to the planar surface of the main panel.

13. The tray of claim 7 wherein said sloping edge slopes downwardly at about 45° with respect to the planar surface of said main panel.

* * * * *